US008389134B2

(12) United States Patent
Van Den Berg et al.

(10) Patent No.: US 8,389,134 B2
(45) Date of Patent: Mar. 5, 2013

(54) BODY COATED WITH HARD MATERIAL

(75) Inventors: Hendrikus Van Den Berg, Ligusterpad (NL); Hartmut Westphal, Dermbach/Rhoen (DE); Volkmar Sottke, Muelheim/Ruhr (DE)

(73) Assignee: Kennametal Inc., Latrobe, PA (US)

( * ) Notice: Subject to any disclaimer, the term of this patent is extended or adjusted under 35 U.S.C. 154(b) by 248 days.

(21) Appl. No.: 12/866,151

(22) PCT Filed: Jan. 20, 2009

(86) PCT No.: PCT/EP2009/000309

§ 371 (c)(1),
(2), (4) Date: Aug. 4, 2010

(87) PCT Pub. No.: WO2009/112115

PCT Pub. Date: Sep. 17, 2009

(65) Prior Publication Data

US 2010/0323176 A1 Dec. 23, 2010

(30) Foreign Application Priority Data

Mar. 12, 2008 (DE) ..... 10 2008 013 965

(51) Int. Cl.
*B32B 9/00* (2006.01)

(52) U.S. Cl. ..... 428/697; 51/307; 51/309; 428/698; 428/699; 428/701; 428/702

(58) Field of Classification Search ..... 51/307, 51/309; 428/697, 698, 699, 701, 702, 704
See application file for complete search history.

(56) References Cited

U.S. PATENT DOCUMENTS

| | | | | |
|---|---|---|---|---|
| 6,040,012 | A | 3/2000 | Anderbouhr et al. | |
| 6,382,951 | B1 | 5/2002 | Soederberg et al. | |
| 6,572,991 | B1 | 6/2003 | Ruppi | |
| 7,767,320 | B2 * | 8/2010 | Endler | 428/697 |
| 2002/0136933 | A1 | 9/2002 | Braendle | |
| 2007/0298280 | A1 | 12/2007 | Omori et al. | |
| 2009/0123779 | A1 | 5/2009 | Endler | |
| 2009/0297835 | A1 | 12/2009 | Okada et al. | |

FOREIGN PATENT DOCUMENTS

| | | | |
|---|---|---|---|
| CN | 1316545 | A | 10/2001 |
| EP | 0899359 | A1 | 3/1999 |
| EP | 1122334 | A1 | 8/2001 |
| EP | 1757389 | A1 | 2/2007 |
| EP | 1825943 | A1 | 8/2007 |
| WO | 0070120 | A1 | 11/2000 |
| WO | WO03085152 | | 10/2003 |
| WO | 2007003648 | A1 | 1/2007 |
| WO | WO2008/059896 | | 5/2008 |

OTHER PUBLICATIONS

Endler et al Novel aluminum-rich T(1-x)Al(x)N coatings by LPCVD. Surface & Coatings Techn 203 (2008) p. 530-533.*

Fox-Rabinovich et al "Effect of temperature of annealing below 900 C on structure, properties and tool life of an AlTiN coating under various cutting conditions". Surface & Coatings Techn 202 (2008) p. 2985-2992.*

Kutchej et al Structure, mechanical and tribological properties of sputtered Ti(1-x)Al(x)N coatings with 0.5<=x=<0.75. Surface & Coatings Techn 200 (2005) p. 23582365.*

Santana et al "The role of hcp-AIN on hardness behavior of Ti (1-x)Al(x)N nanpocomposite during annealing" ThinSolid Films 469-470 (2004) p. 399-344.*

Mayrhofer et al, Influence of the A1 distribution on the structure, elastic properties, and phase stability of supersaturated Ti1-xA1xN, Journal of Applied Physics, 2006, pp. 6-10, vol. 100, 094906, American Institute of Physics.

Shimada et al, Preparation of (Ti1-xA1x)N films from mixed alkoxide solutions by plasma CVD, Thin Solid Films, 2000, vol. 370, pp. 146-150, Elsevier.

Byoung et al, High temperature oxidation of (Ti1-xA1x)N coatings made by plasma enhanced chemical vapor disposition, J. Vac. Sci. Technol. A, Jan./Feb. 1999, pp. 133-137, vol. 17, No. 1.

Sproul, William D., Physical vapor deposition tool coatings, Surface and Coatings Technology, 1996, pp. 1-7, vol. 81.

Lee et al., (Ti1-xA1x)N coatings by plasma-enhanced chemical vapor deposition, J. Vac. Sci. Technol. A, Jul./Aug. 1994, pp. 1602-1607, vol. 12, No. 4.

* cited by examiner

*Primary Examiner* — Archene Turner
(74) *Attorney, Agent, or Firm* — Matthew W. Gordon, Esq.

(57) ABSTRACT

The invention relates to a body which is coated with hard material and has a plurality of layers applied by means of CVD, in which an $Al_2O_3$ layer is arranged as outer layer on a $Ti_{1-x}Al_xN$ layer and/or $Ti_{1-x}Al_xC$ layer and/or $Ti_{1-x}Al_xCN$ layer.

15 Claims, No Drawings

BODY COATED WITH HARD MATERIAL

CROSS REFERENCE TO RELATED APPLICATIONS

This application is the US national phase of PCT application PCT/EP2009/000309, filed 20 Jan. 2009, published 17 Sep. 2009 as 2009/112115, and claiming the priority of German patent application 102008013965.3 itself filed 12 Mar. 2008, whose entire disclosures are herewith incorporated by reference.

The invention relates to a body which is coated with hard material and has a plurality of hard material layers applied by means of CVD.

Cutting tools used for cutting machining have to meet demanding requirements in respect of stability and strength, in particular in the cutting machining of hard or tough materials such as tempered or hardened steels by turning at high cutting speeds. The material of the cutting tool should be, in particular, abrasion-resistant, which in the past has led to cemented carbide or cermet substrate bodies being provided with a surface coating, with initially carbides, nitrides or carbonitrides of titanium and later also aluminum oxide layers being used as wear protection coatings. Multilayer wear protection coatings composed of different hard materials are also known. For example, aluminum oxide layers arranged on one or more intermediate layers such as titanium carbonitride or titanium nitride are known as wear-reducing coatings.

WO 03/085152 A2 discloses the use of a Ti—Al—N layer which can be produced as a monophase layer having aluminum contents of up to 60% by means of PVD. At higher aluminum contents, however, a mixture of cubic and hexagonal TiAlN and at even higher aluminum contents only the softer and not wear-resistant hexagonal wurtzite structure is formed.

It is also known that single-phase $Ti_{1-x}Al_x$—N hard material layers in which x=0.9 can be produced by means of plasma CVD. However, the unsatisfactory homogeneity of the layer composition and the relatively high chlorine content of the layer are disadvantages.

When PVD or plasma CVD processes were used for producing $Ti_{1-x}Al_xN$ hard material layers, use of these layers was restricted to temperatures below 700° C. A disadvantage is that the coating of complicated component geometries presents difficulties. PVD is a directed process in which complex geometries are irregularly coated. Plasma CVD requires a high plasma homogeneity since the plasma power density has a direct influence on the Ti/Al atom ratio of the layer. Production of single-phase cubic $Ti_{1-x}Al_x$—N layers having a high aluminum content is not possible by means of the PVD processes used in industry.

Deposition of TiAl by means of a conventional CVD process at temperatures above 1000° C. is also not possible since the metastable $Ti_{1-x}Al_xN$ decomposes into TiN and hexagonal AlN at such high temperatures.

Finally, in the process described in U.S. Pat. No. 6,238,739 B1 for producing $Ti_{1-x}Al_xN$ layers in which x is in the range from 0.1 to 0.6 by means of a thermal CVD process without plasma assistance at temperatures in the range from 550° C. to 650° C., a limitation to relatively low aluminum contents with $x \leqq 0.6$ is indicated. In the process described there, aluminum chlorides and titanium chlorides and also $NH_3$ and $H_2$ are used as gas mixtures. In the case of this coating, too, high chlorine contents of up to 12 atom % have to be accepted.

In order to improve the wear resistance and the oxidation resistance, WO 2007/003648 A1 proposes producing a body which is coated with hard material and has a single-layer or multilayer coating system which contains at least one $Ti_{1-x}Al_xN$ hard material layer by means of CVD, for which purpose the body is coated at temperatures of from 700° C. to 900° C. by means of CVD without plasma excitement in a reactor and titanium halides, aluminum halides and reactive nitrogen compounds which are mixed at elevated temperature are used as precursors. This gives a body having a single-phase $Ti_{1-x}Al_xN$ hard material layer having the cubic NaCl structure and a stoichiometry coefficient x of from >0.75 to 0.93 or a multiphase layer comprising $Ti_{1-x}Al_xN$ having the cubic NaCl structure and a stoichiometry coefficient x of from >0.75 to 0.93 as main phase and a wurtzite structure and/or $TiN_x$NaCl structure as further phase. The chlorine content is in the range from 0.05 to 0.9 atom %. It is also known from this document that the $Ti_{1-x}Al_xN$ hard material layer or layers having up to 30% by mass of amorphous layer constituents can be obtained. The hardness of the layers obtained is in the range from 2500 HV to 3800 HV.

To improve the adhesion of a $Ti_{1-x}Al_xN$ hard material layer at a high wear resistance, DE 10 2007 000 512, which is not a prior publication, also proposes that the layer system applied to a substrate body comprises a bonding layer of titanium nitride, titanium carbonitride or titanium carbide applied to the body, followed by a phase gradient layer and finally an outer layer of a single-phase or multiphase $Ti_{1-x}Al_xN$ hard material layer. The phase gradient layer comprises, on its side facing the bonding layer, a TiN/h-AlN phase mixture and with increasing layer thickness has an increasing proportion of fcc-TiAlN phase in a proportion of more than 50% and, associated therewith, a simultaneous decrease in the proportion of TiN and h-AlN phases.

Apart from the abrasion and oxidation resistance of a layer on a cemented carbide, cermet or substrate body, the thermal stability of the coating is of great importance for the use of this material in cutting machining, in particular at high cutting speeds. Temperatures significantly above 1000° C. occur in the region of a cutting edge of a cutting insert during turning of hard work pieces. At such temperatures, different coefficients of expansion of the substrates between the individual layers have a considerable effect. Stresses arise between the individual layers and, if the high temperature is transported by thermal conduction from the outer layer to the substrate body, in the most unfavorable case detachment of the coating will occur, making the cutting insert unusable.

It is thus an object of the present invention to provide a body which is coated with hard material and whose coating has a better thermal insulating effect in respect of heat transport as a result of selection of the individual layers.

This object is achieved by a body coated with hard material as claimed in claim 1. The body coated with hard material has a plurality of layers, with an $Al_2O_3$ layer being arranged as outer layer on a $Ti_{1-x}Al_xN$ and/or $Ti_{1-x}Al_xC$ and/or $Ti_{1-x}Al_xCN$ layer where x is from 0.65 to 0.95.

The use of a $Ti_{1-x}Al_xN$, $Ti_{1-x}Al_xC$ or $Ti_{1-x}Al_xCN$ layer instead of a TiCN layer as generally used in the prior art has the advantage that the thermal conductivity of the layer arranged underneath the $Al_2O_3$ layer is about 80% lower, so that the $Ti_{1-x}Al_xN$, $Ti_{1-x}Al_xC$ or —CN layer proves to be significantly better thermal insulation to the substrate body. The outer $Al_2O_3$ layer is also more oxidation resistant and, compared to a TiCN outer layer, about 50% harder, so that greater wear resistance is obtained.

In addition, it has surprisingly been found that a $Ti_{1-x}Al_xN$, $Ti_{1-x}Al_xC$ or —CN layer as an intermediate layer has no tendency to suffer from cracking compared to a TiN or TiCN intermediate layer, so that the disadvantageous typical network of cracks obtained according to the prior art is not formed. Particularly in the case of an interrupted cut, the improved cracking resistance increases the operating life.

The $Ti_{1-x}Al_xCN$, $Ti_{1-x}Al_xC$ or $Ti_{1-x}Al_xN$ layer can consist of a single phase and have a cubic structure or can consist of a plurality of phases and in addition to a main cubic phase have a further phase having a wurtzite structure and/or composed of TiN. Amorphous layer constituents can be present up to 30% by mass. The chlorine content is in the range from 0.01 to 3 atom %.

In a further embodiment of the invention, a TiN and/or TiCN layer can be used as bonding layer to the substrate body which comprises a cemented carbide, a cermet or a ceramic, so that the layer sequence from the inside outward is TiN— or TiCN—TiAlC(N)—$Al_2O_3$.

For the purposes of the present invention, TiCN layers are also possible between the $Al_2O_3$ outer layer and the $Ti_{1-x}Al_xN$ layer, $Ti_{1-x}Al_xC$ layer or $Ti_{1-x}Al_xCN$ layer.

The proportion of aluminum, calculated as metal, is preferably from 70% to 90%. The thickness of a $Ti_{1-x}Al_xN$ layer, $Ti_{1-x}Al_xC$ layer or $Ti_{1-x}Al_xCN$ layer can vary in the range from 2 μm to 10 μm, preferably from 3 μm to 7 μm. The abovementioned layer can also contain proportions of hexagonal aluminum nitride, not more than 25%.

For the purposes of the present invention, it is also possible to have, instead of a single intermediate layer, a multilayer intermediate layer composed of one or more double layers or triple layers of the type $(Ti_{1-x}Al_xN, Ti_{1-x}Al_xC, Ti_{1-x}Al_xCN)_n$ where n is a natural number. The TiAlN/TiAlCN/TiAlC alternating layer then has a total thickness, given by the sum of the thicknesses of each of the individual layers, which is in the range from 1 nm to 5 nm. The total thickness should preferably be from 1 μm to 5 μm. In the simplest case, thin individual layers of $Ti_{1-x}Al_xN$ or $Ti_{1-x}Al_xCN$ or $Ti_{1-x}Al_xC$ having a thickness of only a few nm are applied successively until the desired total thickness in the range from 1 μm to 5 μm has been reached. However, it is also possible to have an alternating layer system made up of the abovementioned compositions, including layers which have sublayers having a gradient in which the proportion of C decreases or increases in an outward direction.

The TiAlN, TiAlC or TiAlCN layer can contain up to 30% of amorphous constituents and have chlorine contents of up to 3 atom %.

To produce the coated body, the substrate body comprising a cemented carbide, a cermet or a ceramic is subjected to CVD coating at coating temperatures in the range from 650° C. to 900° C., with titanium chloride and aluminum chloride and also ammonia being introduced into the gas atmosphere to produce a TiAlN layer. After a first layer having a thickness in the range from 2 μm to 10 μm, preferably from 3 μm to 7 μm, has been produced, an $Al_2O_3$ layer having a thickness of at least 2 μm and not more than 10 μm is applied in a conventional way by means of the CVD process.

The invention claimed is:

1. A body coated with hard material and having a plurality of layers applied by CVD, wherein an $Al_2O_3$ layer is an outer layer on a $Ti_{1-x}Al_xN$ layer and/or $Ti_{1-x}Al_xC$ layer and/or $Ti_{1-x}Al_xCN$ layer, x being from 0.65 to 0.95 and a TiN or TiCN layer is a bonding layer to the substrate which comprises cemented carbide, a cermet or a ceramic.

2. The body coated with hard material as claimed in claim 1 wherein a TiCN layer is arranged between the $Al_2O_3$ outer layer and the $Ti_{1-x}Al_xN$ layer, $Ti_{1-x}Al_xC$ layer or $Ti_{1-x}Al_xCN$ layer.

3. The body coated with hard material as claimed in claim 1 wherein x in the $Ti_{1-x}Al_xN$ layer, $Ti_{1-x}Al_xC$ layer or $Ti_{1-x}Al_xCN$ layer is such that $0.7 \leqq x \leqq 0.9$.

4. The body coated with hard material as claimed in claim 1 wherein a multilayer intermediate layer composed of one or more double layers or triple layers from the group $(Ti_{1-x}Al_xN, Ti_{1-x}Al_xCN, Ti_{1-x}Al_xC)_n$ is arranged below the $Al_2O_3$ layer.

5. The body coated with hard material as claimed in claim 1 wherein the thickness of the outer layer is in the range from 1 μm to 5 μm, the thickness of the $Ti_{1-x}Al_xN$, $Ti_{1-x}Al_xC$ or $Ti_{1-x}Al_xCN$ layer is from 1 μm to 5 μm and the thickness of any further bonding or intermediate layers is in the range from 1 μm to 5 μm.

6. The body coated with hard material as claimed in claim 1 wherein the $Ti_{1-x}Al_xN$, $Ti_{1-x}Al_xC$ or $Ti_{1-x}Al_xCN$ layer contains not more than 25% of hexagonal AlN.

7. The body coated with hard material as claimed in claim 1, wherein the $Ti_{1-x}Al_xN$ layer, $Ti_{1-x}Al_xC$ layer or $Ti_{1-x}Al_xCN$ layer does not comprise a network of cracks.

8. The body coated with hard material as claimed in claim 1, wherein the body is a cutting tool for interrupted cut applications.

9. A body coated with hard material having a plurality of layers applied by CVD, wherein an $Al_2O_3$ layer is an outer layer on a $Ti_{1-x}Al_xN$ layer, $Ti_{1-x}Al_xC$ layer or $Ti_{1-x}Al_xCN$ layer applied to a substrate of cemented carbide, cermet or ceramic with x being from 0.65 to 0.95, wherein the body is a cutting tool for interrupted cut applications.

10. The body coated with hard material as claimed in claim 9 wherein a TiCN layer is arranged between the $Al_2O_3$ outer layer and the $Ti_{1-x}Al_xN$ layer, $Ti_{1-x}Al_xC$ layer or $Ti_{1-x}Al_xCN$ layer.

11. The body coated with hard material as claimed in claim 9 wherein x in the $Ti_{1-x}Al_xN$ layer, $Ti_{1-x}Al_xC$ layer or $Ti_{1-x}Al_xCN$ layer is such that $0.7 \leqq x \leqq 0.9$.

12. The body coated with hard material as claimed in claim 9 wherein a multilayer intermediate layer composed of one or more double layers or triple layers from the group $(Ti_{1-x}Al_xN, Ti_{1-x}Al_xCN, Ti_{1-x}Al_xC)_n$ is arranged below the $Al_2O_3$ layer.

13. The body coated with hard material as claimed in claim 9 wherein the thickness of the outer layer is in the range from 1 μm to 5 μm, the thickness of the $Ti_{1-x}Al_xN$, $Ti_{1-x}Al_xC$ or $Ti_{1-x}Al_xCN$ layer is from 1 μm to 5 μm and the thickness of any further bonding or intermediate layers is in the range from 1 μm to 5 μm.

14. The body coated with hard material as claimed in claim 9 wherein the $Ti_{1-x}Al_xN$, $Ti_{1-x}Al_xC$ or $Ti_{1-x}Al_xCN$ layer contains not more than 25% of hexagonal AlN.

15. The body coated with hard material as claimed in claim 9, wherein the $Ti_{1-x}Al_xN$ layer, $Ti_{1-x}Al_xC$ layer or $Ti_{1-x}Al_xCN$ layer does not comprise a network of cracks.

* * * * *